US006210511B1

(12) United States Patent
Nolan et al.

(10) Patent No.: US 6,210,511 B1
(45) Date of Patent: Apr. 3, 2001

(54) METHOD AND APPARATUS FOR PRODUCING NONWOVEN FIBROUS FABRIC AT HIGH RATE OF SPEED

(75) Inventors: Benjamin Michael Nolan, Elmer; Joseph F. Merker, Pittsgrove, both of NJ (US)

(73) Assignee: Fibertech Group, Landisville, NJ (US)

( * ) Notice: Subject to any disclaimer, the term of this patent is extended or adjusted under 35 U.S.C. 154(b) by 0 days.

(21) Appl. No.: 08/698,815

(22) Filed: Aug. 16, 1996

(51) Int. Cl.[7] ..... D04H 3/08

(52) U.S. Cl. ..... 156/181; 156/296; 156/308.2; 156/309.9; 428/198; 442/409

(58) Field of Search ..... 28/103, 116, 122, 28/158; 442/409; 428/196, 198; 156/181, 296, 308.2, 309.9

(56) References Cited

U.S. PATENT DOCUMENTS 4,003,783 * 1/1977 Groome et al. .
4,574,433 * 3/1986 Brunnschweiler .
5,361,451 * 11/1994 Fehrer .
5,494,736 * 2/1996 Willey et al. .

FOREIGN PATENT DOCUMENTS

03269154 * 11/1991 (JP) .

* cited by examiner

*Primary Examiner*—Elizabeth M. Cole
(74) *Attorney, Agent, or Firm*—Pyle & Piontek

(57) ABSTRACT

In the production of a nonwoven fabric of thermally bonded fibers, a heavy web of fibers is continuously fed to a toothed cylinder at a slow speed to form a layer of fibers, and a portion of this layer is removed and formed into a light-weight uniform web at a faster speed. The second web is conveyed without draw to a calender having a bonding nip, and the fibers of the web are rearranged by compression and heating and are supported on a hot surface of one of the calender rolls prior to entering the nip to additionally improve uniformity.

16 Claims, 3 Drawing Sheets

METHOD AND APPARATUS FOR PRODUCING NONWOVEN FIBROUS FABRIC AT HIGH RATE OF SPEED

BACKGROUND OF THE INVENTION

This invention relates to a method and apparatus for rapid formation of a highly uniform nonwoven web of staple fibers and is particularly suitable for the formation of the low basis weight webs of thermoplastic fibers at a high rate of speed.

Nonwoven fabrics are produced by a variety of methods, and in general, such methods involve the continuous lay-down of fibers or filaments in the form of an unconsolidated flat web on a conveyor, followed by consolidation of the web, such as by bonding or locking the fibers together to form the web into a cohesive fabric.

The carding of staple fibers into an unconsolidated web followed by point bonding with a hot calender is one well known method of producing a nonwoven fabric. In such a process the fibers, which are received in bales, are first opened with standard textile opening equipment. The opened fibers are then fed to single or multiple cards which are installed in line, each forming a thin web. The webs are then layered together, then usually spread to increase web width, and fed to a hot calender for thermal bonding. The customary calender consists of two heated rolls, one being a smooth steel anvil roll, the other being a roll with an embossed pattern. The high points of the pattern are the area where the fibers are bonded together through partial melting. Such systems can produce webs which are reasonably uniform at a given speed and basis weight. Typically, a reduction in unit weight or an increase in speed results in a noticeable degradation in the uniformity of the fiber distribution. More precisely, at lower basis weights the web develops a more blotchy appearance due to areas of higher and lower concentrations of fibers. In the worst case, holes will form where the concentration of fiber is low. The degradation in web uniformity for the traditional system is also linked to the need of additional draw on the unbonded web to eliminate the bulging of the web which would otherwise occur at various points in the process. The amount of draw used to control the web during transport to the calender is inversely proportional to the cohesion of the unbonded web. A low cohesion web will require a higher draw. The spreading section and the calender nip point are prime areas where the bulging occurs. This bulging, if not eliminated, causes extremely poor web uniformity. A lighter web, when submitted to such increase in draw, develops even greater defects because the extremely light areas are now deformed into holes in the web.

The prior art has tried to minimize the requirement for draw by using equipment transfer geometry and higher cohesion fiber to produce nonwoven material at higher production speeds. Both modifications have produced only moderate improvements in speed or uniformity.

Other prior art has been the development of a machine which reorganizes the carded unbonded web (with minimal or no increase in output speed) by reforming it on a vacuum collector such as described in U.S. Pat. No. 4,475,271. This process can produce a web with a more uniform balance in tensile strength between the MD and CD direction but, it does not deliver the desired level of uniformity in fiber distribution as judged by visual appearance.

SUMMARY OF THE INVENTION

In accordance with the present invention, a slow moving thick or high basis weight web of fibers having a high degree of cohesion, is formed using conventional cards, or other mechanisms. This web may be first spread in the cross machine direction.

The thick web is fed into a relatively fast moving toothed reforming roll, which carries a layer of excess recirculating fibers needed to form the final web. A uniform portion of the layer of fibers is continuously removed from the reforming roll by a toothed web forming roll, and this web layer is transferred as a web to a conveyor by a transfer roll. The web is subsequently bonded.

In the preferred embodiment, the reformed web is fed from the conveyor around an air control transfer roll, which allows the web to change direction without lifting or disruption, with the exit of the air control roll being located closely adjacent the upper heated roll of the rotating calender rolls.

The web is not fed directly into the nip between the calender rolls. Rather, the web is transferred to the upper hot calender roll into a secondary nip between the transfer roll and hot calender roll, in an area upstream of the nip. The unconsolidated web is then heated and compressed in the secondary nip and is supported on the hot roll prior to entry into the calender nip to become thermally bonded.

As the web passes through the secondary nip, the web is compressed, causing fibers to move relative to each other in a more uniform arrangement. This effect is aided by contact of the web with the heated roll in which individual heated fibers may shrink, curl or relax as they are being physically rearranged by compression. The rearranged web is partially wrapped and supported on the heated roll, which tends to eliminate any bulging of the web due to passage through the calender.

Downstream of the reformer roll, all rolls and conveyor operate at substantially the same surface speed, and no substantial machine direction draw is imparted to the reformed web due to transport or thermal bonding. Thus, very light weight or low cohesive webs may be processed at high speeds without any loss in uniformity, and, in fact, uniformity is increased in the final stages of processing.

In summary, the invention can be considered as having several general aspects. First, a web of staple fibers having a first basis weight and moving at a first speed is converted into a second, more uniform web having a second, lower basis weight and moving at a second, higher, surface speed. This is accomplished by continuously metering a layer of fibers from the first web onto a rapidly rotating toothed cylinder and removing a uniform portion of said layer to form the second web moving at the second speed. The second web is subsequently bonded.

In a broad second aspect, a web of individual fibers, including at least some thermally bondable fibers, is subjected to preconditioning immediately prior to passage through a nip of a bonding calender. The preconditioning involves subjecting the web to heat and compression which is sufficient to at least partially rearrange the fibers in a more uniform array, but insufficient to thermally bond the fibers.

A third broad aspect comprises supporting a web of unbonded thermoplastic fibers on a heated surface immediately prior to entry into the nip of a calender. The second and third aspects are preferably accomplished using a heated roll of the calender to heat, compress and support the web upstream of the bonding nip.

A fourth broad aspect is to support the web of individual fibers to be thermally bonded at a substantially constant surface speed between the zone of formation and into and through the bonding zone in order to minimize any draw on the web after final web formation and to prevent loss of uniformity due to draw.

DESCRIPTION OF THE PREFERRED EMBODIMENTS

Figure 1:
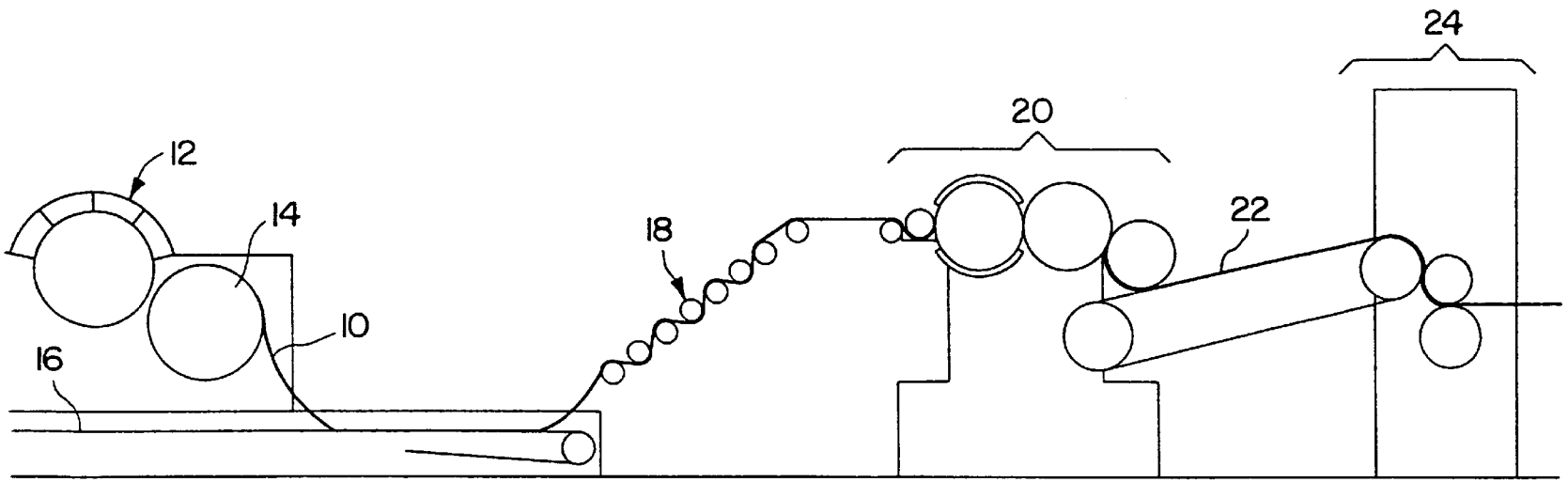
FIG. 1 is a side schematic view of the overall apparatus for carrying out the method of the present invention.

FIG. 1 shows the overall apparatus representative of a production line capable of carrying out the various aspects of the present invention.

A relatively thick or high basis weight of a web 10 of unconsolidated fibers is first prepared. The web 10 may be formed by use of one and preferably a series of a plurality of conventional cards 12 which serve to separate clumps of fibers from a bale into individual fibers and to deposit the fibers via a take-off roll 14 onto a moving conveyor 16.

The web 10 comprises individual staple fibers which are capable of being bonded by conventional techniques. The initial part of the present method may be used to form uniform webs of fibers which are subsequently consolidated by thermal or non-thermal means. Non-thermal methods include techniques in which the surfaces of the fibers are not melted or softened to achieve bonding, including techniques such as chemical or adhesive (liquid or solid) bonding and hydraulic entanglement. In such cases, polymer fibers having higher melting points can be employed, such as polyester and polyamide, as well as other fibers such as polyolefin.

The web as initially formed may also be bonded by thermal methods such as the application of heat, pressure and heat, or by the use of sonic techniques. Thermal bonding methods include, for example, through-air bonding using hot air, and passage of the web through the nip of a pair of heated calender rolls, one having an embossed surface with raised areas to define the bond sites. In such a case, fibers which have a relatively low melting point are used alone or in admixture with other fibers. Suitable thermoplastic fibers of this nature include polyolefins, such as polyethyle and polypropylene, multi-component fibers having an outer polyolefin surface, uand mixtures thereof. In the preferred embodiment, the fibers or fiber mixtures are capable of being bonded by passage through a conventional bonding calender.

The initially formed web 10, typically having a basis weight of from about 30 to about 90 grams per square meter (gsm) may be conveyed from the conveyor 16 to a conventional spreader 18, which functions to increase the width of the web 10 in the cross machine direction. Since the web is relatively thick and cohesive at this stage, the spreading operation does not cause excessive loss in gross uniformity. At this stage, the web will be moving at a speed in the order of from about 50 to about 80 meters per minute.

The above apparatus is conventional in nature and provides an initial feed web for subsequent processing in accordance with the present invention. The use of any known process for opening and individualizing fibers to form the initial web 10 is expected to suffice for the purpose of the present invention.

In accordance with the present invention, the initial web 10 is first processed through a web reformer station 20 which results in a highly uniform web 22 having a basis weight of from about 20 to about 70 percent of the basis weight of the initial web, typically 10 to 30 gsm, and moving at a line speed of from about 150 to 500 percent greater than the line speed of the initial web, typically in the order of 150 to 250 meters per minute. The web 22 is then conveyed to a final fiber rearrangement and bonding station 24, wherein the fibers are subjected to additional mechanical and thermal rearrangement shortly prior to bonding.

Figure 2:
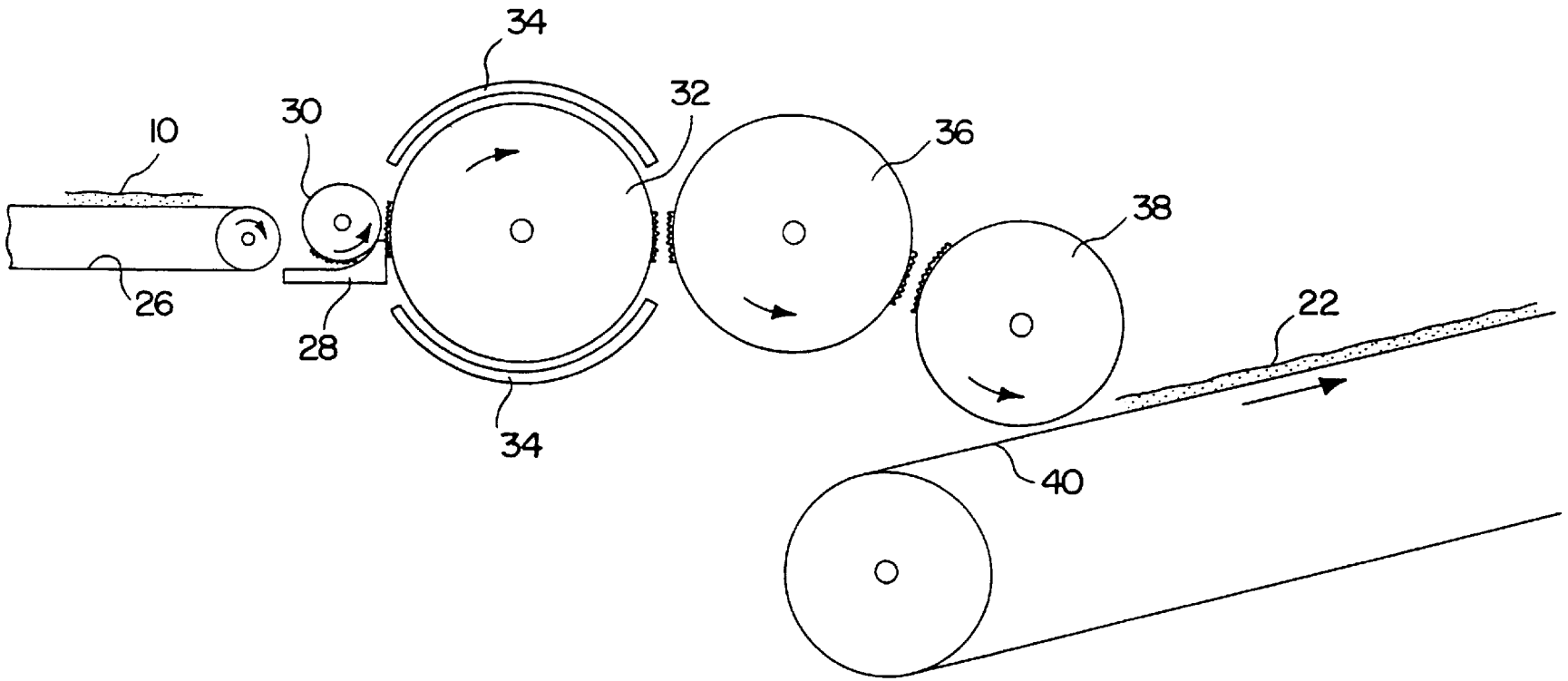
FIG. 2 is an enlarged portion of a first part of the apparatus shown in FIG. 1.

The reformer station 20 is shown in FIG. 2, with the feed web 10 and reformed web 22 being omitted between rolls for the sake of clarity. The initial web 10 exits a conveyor 26 and is deposited between a lower curved support 28 and a toothed feed roll 30. The feed roll 30 meters fibers onto a toothed cylinder 32 operating at substantially a faster surface speed and in the same direction (see arrows) than the feed roll. Semi-cylindrical covers 34 are preferably provided around the moving periphery of cylinder 32 in a closely spaced relation to uniformly guide the flow of air created by the cylinder and to prevent disturbance of fibers residing thereon by outside influences. The fibers are not carded by the cylinder 32, as this would reduce production speed.

A toothed forming roll 36 is provided, at a close distance from the cylinder 32 and rotates in an opposite rotary direction. The cylinder 32 deposits a uniform layer of fibers resident as the outer layer of fibers on the cylinder onto the forming roll 36. Thus, the cylinder 32 carries an amount of fibers in excess of that required to establish the reformed or second web 22. As the cylinder 32 rotates past the feed roll 30, areas lacking a sufficient population of fibers to form a uniform layer will tend to pick up more fibers from the feed. Thus, the feed roll, cylinder and forming roll work in dynamic conjunction to provide a highly uniform web of unbonded fibers at a high rate of speed. The surface speed of the cylinder 32 is substantially greater than the surface speed of the forming roll 36, preferably in the order of from about 3.5 to about 10 times faster.

A toothed takeoff roll 38, located at a close distance from the forming roll 36 and rotating in an opposite direction, removes the entire reformed web 22 from the forming roll and deposits the same on a moving conveyor 40, which is preferably upwardly inclined relative to horizontal machine direction travel.

The reformed web of individual fibers 22, which is now in a highly uniform and fast moving state, may be consolidated or bonded by any suitable thermal or non-thermal technique as described hereinabove. Preferably, however, the web 22 comprises heat bondable fibers and is subjected to additional conditioning, followed by bonding by passage through a conventional heated calender having one or two pattern rolls.

Figure 3:
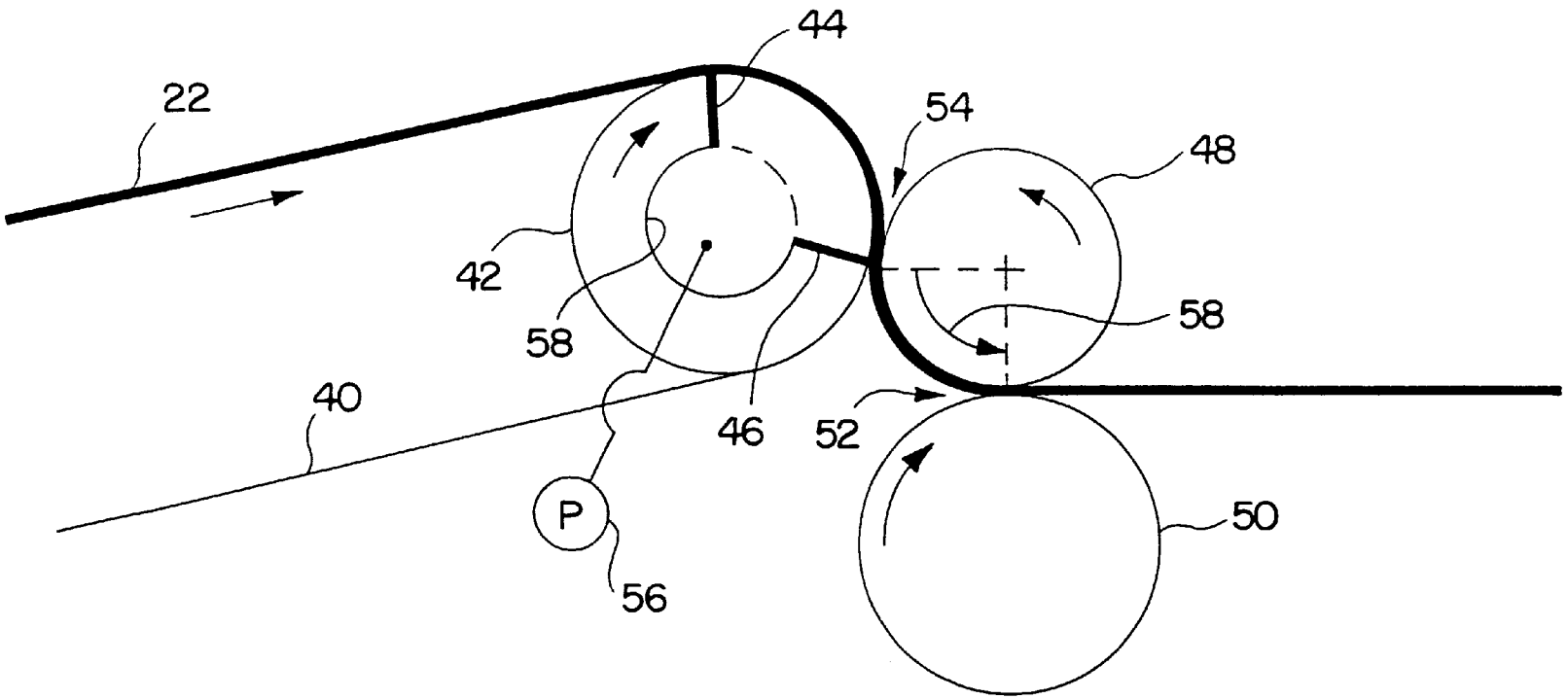
FIG. 3 is an enlarged portion of a second part of the apparatus shown in FIG. 1.

In the preferred embodiment, the reformed web 22 is subjected to final processing and bonding at the station 24 as shown in FIG. 3. The conveyor belt 40 is preferably of mesh construction allowing air flow therethrough of at least 300 CFM per square foot. An air flow transfer roll 42 supports the exit return loop of the conveyor belt 40. A pair of spaced fixed radial air seals 44 and 46 are provided across the width of the roll 42. The first seal 44 intersects the belt 40 and the supported web 22 at approximately the 12 o'clock position on roll 42, as shown.

A calender apparatus is provided closely adjacent the air transfer roll 42 and comprises an upper smooth heated roll 48 and a lower embossed or patterned roll 50, rotating in opposite directions as indicated by the arrows as shown. In the alternative, the upper roll 48 may have an embossed or patterned surface, and the lower roll 50 may be patterned or smooth. The upper roll 48 is in tangential relation with the air transfer roll 42 and is slightly spaced therefrom, as will be explained in greater detail. A first nip 52 is defined between the calender rolls 48 and 50, where thermal/pressure bonding occurs, and a second nip 54, upstream of the first nip, is defined between the air transfer roll 42 and the upper calender roll 48. The second seal 46 intersects the second nip 54.

Suitable means, such as an air pump 56, are connected to a plenum chamber 58 to cause a uniform flow of air to be drawn through the porous conveyor belt 40 and into and across the web 22 in the zone between the fixed seals 44 and 46. Since the web will typically be light in weight and highly porous, the purpose of this air flow is not to provide a positive pressure drop or seal for the transfer process. Rather, the purpose is to control the boundary layer air which would normally move away from the roll as speed is increased. The negative air flow allows the web to be transferred without disturbance and also prevents the possibility of turbulence and hence disruptive forces at the second nip 54.

It has been found that the nip 54 established between the rolls 42 and 48 should be in the order or 0.250 in. (0.635 cm) or less. As the reformed web 22 enters the nip 54, the web is compressed between the two rolls, and the fibers in the web are heated by the hot calender roll. The simultaneous heating and compression causes at least a partial rearrangement of the fibers due to mechanical and thermal influences, allowing the fibers to shrink and relax as well as to move relative to one another and in three dimensions into the most efficiently packed or uniform arrangement while the fibers remain unbonded.

The web 22 adheres to and is supported by the heated calender roll through a quadrant of rotation 60 until the web passes through the first nip 52 where permanent point bonding between the fibers occurs. In prior art arrangements the web passes through an unsupported area prior to the nip of the calender, and due to compressive forces at the nip, a bulge in the web can form prior to the nip, with the only available solution being to increase the machine direction draw on the web by increasing the speed of the calender rolls relative to the speed of the web feed. In the present arrangement, the final rearrangement of the fibers and the support of the web on the roll 48 serve to eliminate any tendency to bulge.

Apparatus of the prior art requires a substantial amount of draw to enable processing. In the present apparatus, the draw between the forming roll 36 and the bonding nip 52, if any, is less than 5% and most preferably less than 3%. Thus, the surface speed of all components downstream of the cylinder 34 is substantially the same. As a result, bonded webs of a low basis weight and uniformity can be formed at a speed up to 30–40% greater than available on a conventional line. As a result, it is possible to produce light weight nonwoven webs of very high uniformity and at high production rates and low cost, in comparison to prior art methods.

What is claimed is:

1. A method for making a nonwoven fabric, said method comprising the steps of forming a first web of thermally bondable fibers having a first basis weight, metering said first web onto a rotating toothed cylinder at a first surface speed to provide a layer of individual fibers, continuously removing a portion of said layer of fibers on said cylinder to form a second web having a second basis weight lower than said first basis weight and moving at a second surface speed faster than said first surface speed, heating and compressing said second web to redistribute said fibers into a uniform array without thermally bonding the fibers, and then thermally bonding said fibers of said second web.

2. The method of claim 1 wherein the step of thermally bonding comprises passing the web through a nip of a pair of calender rolls.

3. The method of claim 2 wherein one of said calender rolls is heated, and subsequent to said heating and compressing, the web is supported on the heated calender roll prior to passing the web through said nip.

4. The method of claim 3 wherein said web is heated and compressed in a secondary nip comprising said heated calender roll.

5. The method of claim 4 wherein said web is heated and compressed in a secondary nip comprising said heated calender roll and a web transfer roll.

6. The method of claim 5 comprising the additional step of creating air flow through said web and into said web transfer roll and stopping said air flow at said secondary nip.

7. The method of claim 1 wherein said web is formed and bonded without any substantial draw on said web.

8. A method of making a nonwoven fabric, said method comprising the steps of forming a first web of thermally bondable individual staple fibers, having a first basis weight, metering said first web onto a first rotating toothed cylinder having a first surface speed to provide a layer of individual fibers, continuously removing a portion of said layer of said fibers on said cylinder with a second toothed rotating cylinder to form a second web having a second basis weight lower than said first basis weight and moving at a second surface speed faster than said first surface speed, heating and compressing said second web to redistribute said fibers in a uniform array without thermally bonding the fibers, moving said second web in a machine direction toward a device capable of bonding said fibers into a coherent web, and during movement of said web between said rotating toothed cylinder and said bonding device, imparting less than 5% draw on said second web.

9. A method of making a nonwoven fabric comprising the steps of first forming a first web of thermoplastic thermally bondable staple fibers having a first basis weight and moving at a first surface speed, metering said first web onto a rotating toothed cylinder to provide a layer of individual fibers, continuously and uniformly removing a portion of said layer of fibers on said cylinder to form a second web having a second basis weight lower then said first basis weight and moving at a second surface speed faster than said first surface speed, heating and compressing said second web to redistribute said fibers into a uniform array without thermally bonding the fibers, and then thermally bonding said fibers to form a nonwoven fabric.

10. The method of claim 9 wherein the fibers of the second web are thermally bonded by passage through the nip of a pair of calender rolls.

11. The method of claim 10 wherein, after said second web is heated and compressed, said second web is supported on a heated surface prior to passage through said nip.

12. The method of claim 11 wherein said calender rolls comprise a heated roll, and said heated roll comprises said heated surface.

13. The method of claim 9 wherein subsequent to the formation of the second web and up to the step of bonding, the second web is subjected to less than 5% of draw.

14. A method for producing a nonwoven fabric comprising the steps of forming a first web of individual thermoplastic thermally bondable staple fibers and having a basis weight of from about 30 to 90 grams per square meter and moving at a speed of from about 50 to about 80 meters per minute, metering said first web onto a toothed rotating cylinder to provide a continuous layer of fibers thereon, engaging said layer of fibers with a rotating toothed web forming roll to remove a portion of said layer of fibers, said toothed rotating cylinder rotating from about 3.5 to about 10 times faster than said web forming roll, depositing the fibers from said web forming roll onto a conveyor to form a second web having a basis weight of from about 10 to about 30 grams per square meter and moving at a speed of from about 150 to about 250 meters per minute, heating and compressing said second web to redistribute said fibers into a uniform array without thermally bonding the fibers, and then bonding said fibers to form a nonwoven fabric.

15. The method of claim 14 wherein said second web is heated and compressed prior to bonding.

16. The method of claim 1 wherein said web comprises thermoplastic fibers, and said web is bonded by calendering.

* * * * *